US009643195B2

(12) United States Patent
Streetmaker

(10) Patent No.: US 9,643,195 B2
(45) Date of Patent: May 9, 2017

(54) HANDHELD SOAP DISPENSING SCRUBBING SHOWER SPRAYER

(71) Applicant: James Streetmaker, El Segundo, CA (US)

(72) Inventor: James Streetmaker, El Segundo, CA (US)

( * ) Notice: Subject to any disclaimer, the term of this patent is extended or adjusted under 35 U.S.C. 154(b) by 0 days.

(21) Appl. No.: 15/250,803

(22) Filed: Aug. 29, 2016

(65) Prior Publication Data

US 2017/0056898 A1 Mar. 2, 2017

Related U.S. Application Data

(60) Provisional application No. 62/210,563, filed on Aug. 27, 2015.

(51) Int. Cl.

| | |
|---|---|
| ***A46B 11/06*** | (2006.01) |
| ***B05B 1/18*** | (2006.01) |
| ***A47K 7/04*** | (2006.01) |
| ***A47K 5/12*** | (2006.01) |
| ***B05B 7/04*** | (2006.01) |

(52) U.S. Cl.

CPC ..... *B05B 1/185* (2013.01); *A46B 11/063* (2013.01); *A46B 11/066* (2013.01); *A47K 5/12* (2013.01); *A47K 7/046* (2013.01); *B05B 7/0408* (2013.01)

(58) Field of Classification Search

CPC ..... A46B 11/063; A46B 11/066; A47K 7/043; A47K 7/046; A47L 7/046

USPC ..... 401/298

See application file for complete search history.

(56) References Cited

U.S. PATENT DOCUMENTS

| | | | | | |
|---|---|---|---|---|---|
| 3,992,744 | A * | 11/1976 | Fassler | A46B 13/06 | 15/22.1 |
| 4,008,503 | A | 2/1977 | Tharp | | |
| 4,089,079 | A * | 5/1978 | Nicholson | A47K 7/046 | 15/29 |
| 4,228,558 | A | 10/1980 | Zhadanov | | |
| 4,703,536 | A * | 11/1987 | Livneh | A46B 13/06 | 15/22.1 |

(Continued)

FOREIGN PATENT DOCUMENTS

| | | | |
|---|---|---|---|
| CA | 1266848 | C | 3/1990 |
| DE | 3902116 | C1 | 10/1990 |
| WO | WO 2012/149967 | A1 | 11/2012 |

OTHER PUBLICATIONS https://www.amazon.com/WhirlyWash-TWI-9001-Water-Powered-Cleaning-System/dp/B000IELP02/ref=cm_cr_arp_d_product_top?ie=UTF8 , WhirlyWash TWI-9001 Water-Powered Cleaning System.

(Continued)

*Primary Examiner* — Jennifer C Chiang

(74) *Attorney, Agent, or Firm* — Edwin P. Tarver; Lauson & Tarver LLP

(57) ABSTRACT

A handheld shower sprayer includes a spray head having a sprayer array and a turbine coupled to a brush, the spray head in communication with a first water line and second water line. The first water line directs the water supply around the turbine, while the second water line drives the turbine with the water supply before it exits the sprayer array. A diverter valve between the second water line and a soap reservoir allows a user to select the second water line and open the diverter valve, diverting some of the water supply against the soap reservoir, and urging the soap into the spray head while the brush moves.

18 Claims, 7 Drawing Sheets

(56) References Cited

U.S. PATENT DOCUMENTS

| | | | | | |
|---|---|---|---|---|---|
| 4,841,590 | A | * | 6/1989 | Terry | A46B 13/06 15/28 |
| 4,998,836 | A | | 3/1991 | Scripnick | |
| 5,065,463 | A | * | 11/1991 | Le | A47K 7/046 15/29 |
| 5,129,121 | A | * | 7/1992 | Gelman | A46B 13/06 15/29 |
| 5,153,962 | A | | 10/1992 | Ritter | |
| 5,246,301 | A | | 9/1993 | Hirasawa | |
| 5,870,782 | A | | 2/1999 | Kannenberg | |
| 5,913,982 | A | | 6/1999 | Phillips | |
| 6,151,728 | A | * | 11/2000 | Wright | A47K 7/046 4/606 |
| 6,584,635 | B1 | | 7/2003 | Kornegay | |
| 6,687,924 | B2 | * | 2/2004 | Wright | A47K 7/046 4/606 |
| 6,775,864 | B2 | | 8/2004 | Cannetti | |
| 6,997,632 | B1 | | 2/2006 | Adams | |
| 7,988,070 | B1 | | 8/2011 | Yang et al. | |
| 8,020,786 | B2 | | 9/2011 | Lo | |
| 8,220,098 | B2 | | 7/2012 | Wilkins | |
| 8,261,395 | B2 | | 9/2012 | Lazarre | |
| 8,343,116 | B2 | | 1/2013 | Ignon | |
| 8,347,443 | B1 | | 1/2013 | Conrad | |
| 8,356,374 | B2 | | 1/2013 | Tybinkowski et al. | |
| 8,360,668 | B1 | | 1/2013 | Hinnant | |
| 8,371,514 | B2 | | 2/2013 | Finell | |
| 8,372,215 | B2 | | 2/2013 | Eli | |
| 2010/0092231 | A1 | | 4/2010 | Kao | |
| 2012/0222695 | A1 | | 9/2012 | Suter | |
| 2012/0260930 | A1 | | 10/2012 | Kimble | |
| 2013/0015266 | A1 | | 1/2013 | Riley et al. | |

OTHER PUBLICATIONS

Trillium Worldwide, http://www.qvc.com/footers/V28875_manual.pdf , Whirlywash Owners' Guide, 2009, Lake Bluff, IL.

https://www.youtube.com/watch?v=Qx3S9wfG5Ck , YouTube, Whirlywash Water-Powered Cleaning System, Mar. 24, 2010.

* cited by examiner

HANDHELD SOAP DISPENSING SCRUBBING SHOWER SPRAYER

This application claims the benefit of the priority filing date of U.S. provisional application Ser. No. 62/210,563, filed on Aug. 27, 2015.

BACKGROUND

Handheld showerheads are well known in the art. Basic models include a flexible water supply tube connected to a handle portion. The handle portion terminates in a head portion through which streams of water exit under pressure. Improvements on this basic design include showerheads having selectable spray patterns, showerheads incorporating brushes adjacent water jets, and showerheads using kinetic energy provided as water travels under pressure through the showerhead to rotate or otherwise move the brush in the showerhead.

While providing a handheld showerheads in lieu of a standard wall-mounted fixture provides accessibility and alleviates the need to move relative to the water source, a problem remains in that users must manipulate bars of soap or soap dispensers with their free hand when showering, which can be difficult for persons suffering arthritis and similar movement-related health issues. Some improvements in handheld showerheads have been developed to address this issue, including providing a soap dispensing apparatus along with the showerhead.

These improvements typically involve a soap chamber adjacent to the showerhead in fluid communication with the water traveling through the showerhead. These types of handheld showerheads have a drawback in that a person must actuate the soap dispenser separate from the handle of the showerhead, which can be more difficult than operating a separate soap dispenser. For this reason, there is a need for a handheld showerhead that incorporates an automatic soap dispensing function directly into the showerhead itself. There is also a need for a handheld soap dispensing showerhead providing a movable brush assembly, which is easy to install and which is easy to refill with soap as necessary.

SUMMARY

A handheld soap dispensing scrubbing shower sprayer for receiving a water supply and dispensing a soap includes a spray head having a sprayer array and a turbine. The turbine is coupled to a brush for moving the brush. The spray head also has a first water line and a second water line both attachable to the water supply. The first water line is routed around the turbine to the sprayer array, while the second water line is routed through the turbine such that the water supply drives the turbine to move the brush. A diverter valve is in fluid communication with the second water line and a soap reservoir containing the soap, and a selector for opening the diverter valve diverts some of the water supply into the soap reservoir, urging the soap from the soap reservoir into the sprayer array while the brush moves.

The shower sprayer preferably includes a reducing gear between the turbine and the brush, and may have a planetary gear engaging a reducing gear between the turbine and the brush. The sprayer array may encircle the brush, and the soap reservoir may include an internal plunger for driving the soap through the soap reservoir. The soap reservoir may have a refilling port for adding the soap to the soap reservoir. Preferably a dispensing control is coupled to the diverter valve for manually activating the diverter valve and the selector rotates to alternate between the first water line and the second water line.

In an alternative embodiment, a handheld soap dispensing scrubbing shower sprayer for connecting to a water supply, dispensing a soap and scrubbing a user, includes a valve assembly connectable to the water supply, the valve assembly comprising a selector for alternatively engaging the water supply to a first water line and a second water line. The first water line and the second water line are in fluid communication with a spray head comprising a sprayer array and a turbine, the turbine coupled to a brush. The first water line is configured such that the water supply is directed around the turbine and out the sprayer array while the second water line is configured such that the water supply is directed against the turbine, driving the turbine and moving the brush. A diverter valve is downstream from the second water line in fluid communication with a soap reservoir, and the diverter valve opens to divert some of the water supply in the second water line against the soap reservoir, urging the soap out of the soap reservoir and into the spray head for soapably scrubbing the user.

Like the first embodiment, the shower sprayer of claim may include a reducing gear between the turbine and the brush. It may also have a dispensing control coupled to the diverter valve for manually activating the diverter valve, and a dispensing control for manually activating the diverter valve.

DESCRIPTION

Figure 1:
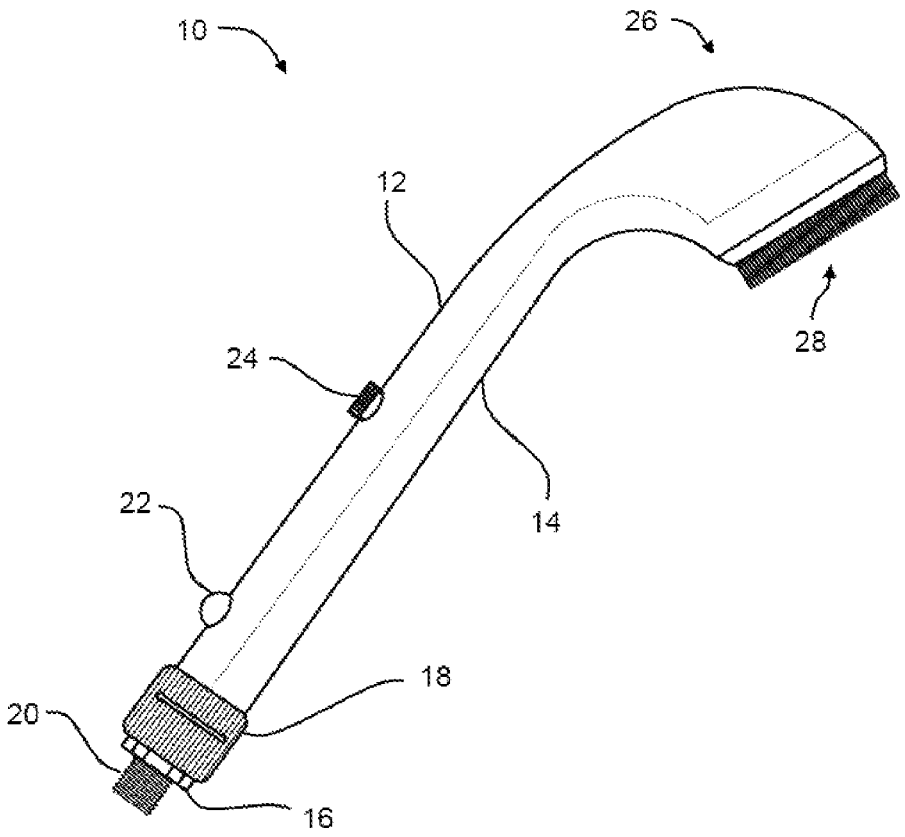
FIG. 1 illustrates an elevational view of a handheld soap dispensing scrubbing shower sprayer.

Referring to FIG. 1, a handheld shower sprayer 10 includes an upper body housing 12 and a lower body housing 14. A valve assembly 16 controlled by a selector 18 which is preferably a rotating selector 18, includes a connector 20 for connecting the shower sprayer 10 to a water supply (not shown). A dispensing control 22 on the upper body housing 12 allows a user (not shown) to dispense soap (not shown) from the shower sprayer 10 and a refilling port 24 allows the user to refill the shower sprayer 10 with soap when empty. A spray head 26 opposite the control 22 includes moving brushes 28 and a sprayer array 30 for releasing the water supply, encircling the brushes 28.

Figure 2:
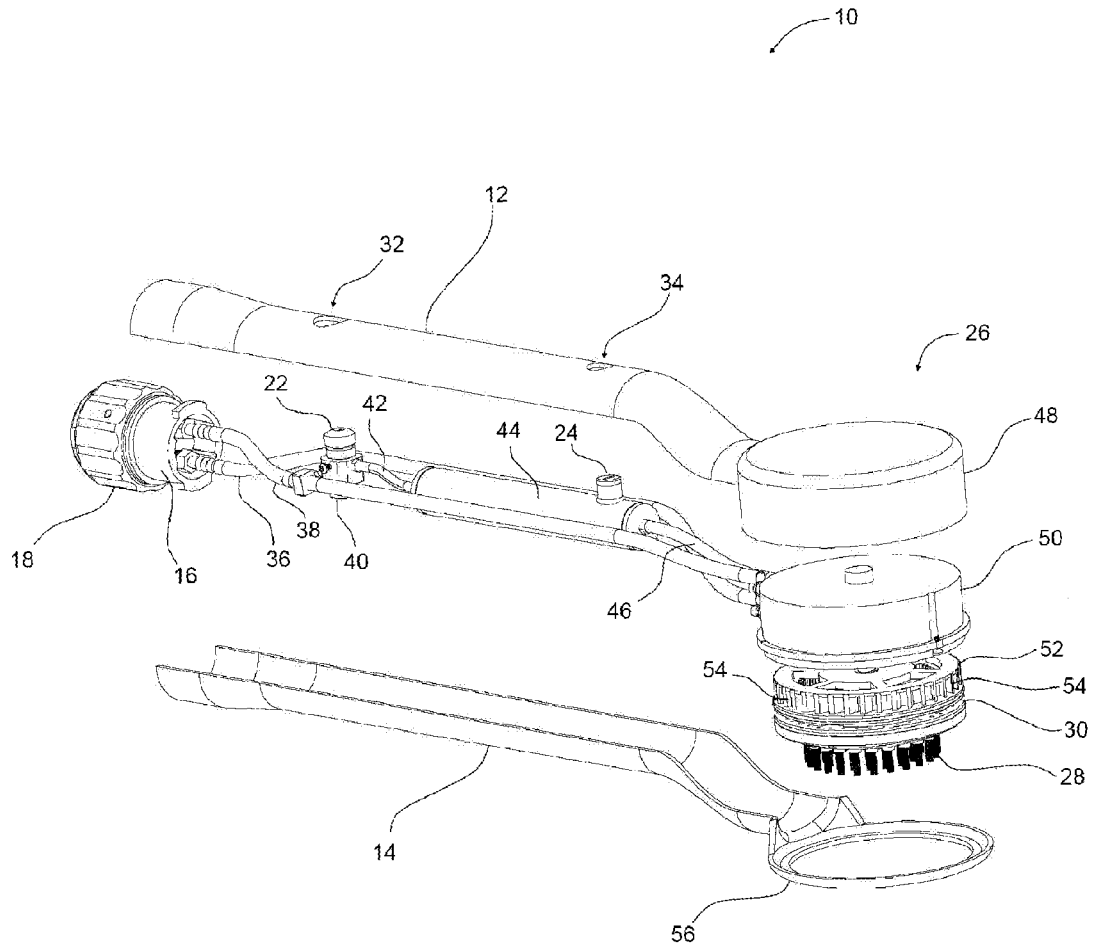
FIG. 2 illustrates an exploded view of the shower sprayer and its internal components.
Figure 3:
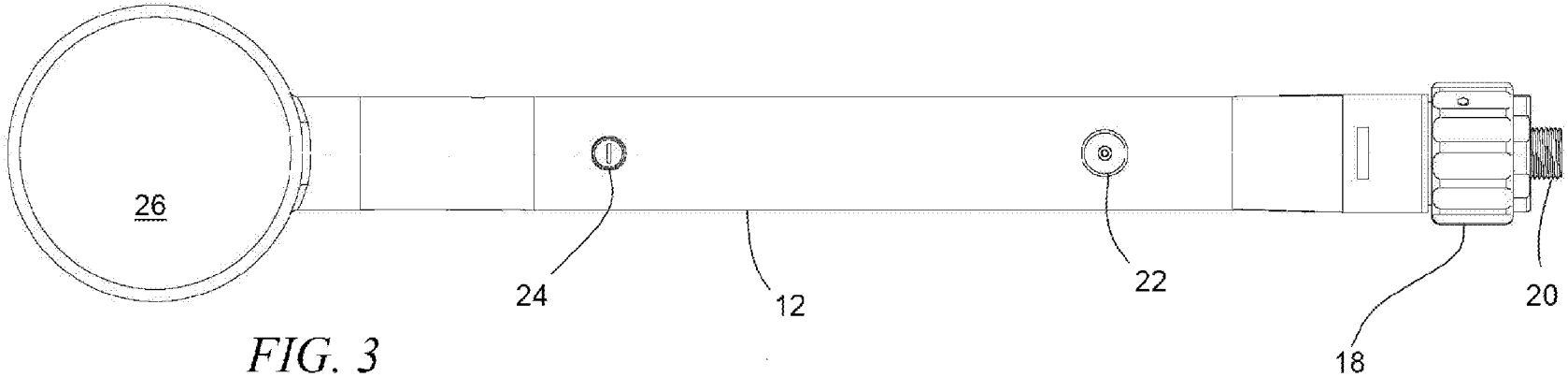
FIG. 3 illustrates a top view of the shower sprayer.

Referring to FIGS. 2 and 3, the upper body housing 12 includes a first hole 32 and a second hole 34 that provide access to the dispensing control 22 and the refilling port 24, respectively. Extending from the valve assembly 16, a first water line 36 travels directly to the spray head 26. A second water line 38 extends from the valve assembly 16 to both a diverter valve 40 and the spray head 26. When closed, the diverter valve 40 forces water (not shown) to travel through the second water line 38 directly to the spray head 26, substantially parallel to the first water line 36. When the diverter valve 40 is open, it allows a portion of the water to travel through a first soap line 42 into a soap reservoir 44. Pressure from the diverted water causes the soap reservoir 44 to push soap (not shown) through a second soap line 46 and into the spray head 26.

At the spray head 26, the upper body housing 12 forms a cylindrical case 48 for holding a capsule assembly 50. The capsule assembly 50 includes a turbine 52 for rotating the brushes 28. Water entering the capsule assembly 50 from the first water line 36 or the second water line 38 engages vanes 54 on the turbine 52 under pressure, causing the turbine 52 and brushes 28 to spin. A retaining ring 56 on the lower body housing 14 helps secure the capsule assembly 50, including the turbine 52, sprayer array 30 and brushes 28, in the cylindrical case 48.

Figure 4:
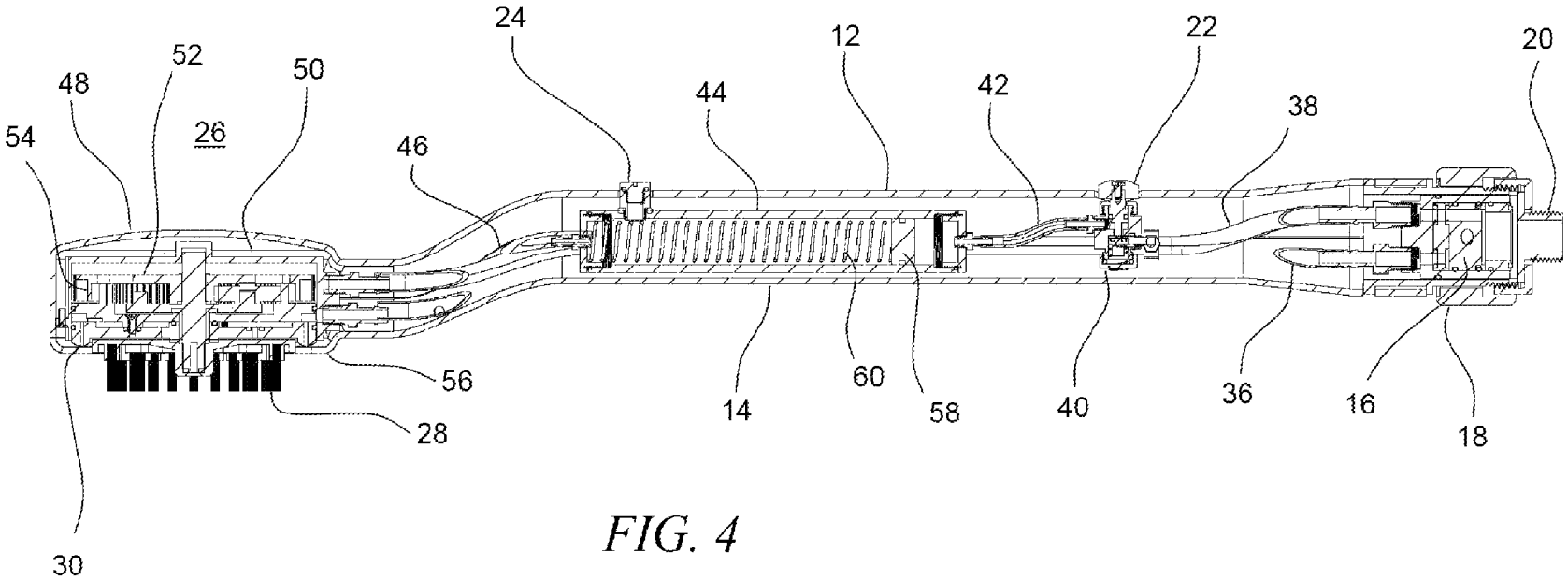
FIG. 4 illustrates a section view of the shower sprayer.

Referring to FIG. 4, a section view of the shower sprayer 10 illustrates the internal workings of the soap reservoir 44. When the selector 18 is turned to direct water (not shown) through the second water line 38, and the dispensing control 22 depressed, water travels through the diverter valve 40 and the first soap line 42 into the soap reservoir 44. Inside the soap reservoir 44, the water impinges on a plunger 58, driving it forward, and forcing soap (not shown) through the second soap line 46 and into the spray head 26. In one embodiment, a spring 60 is provided for returning the plunger 58 to a fully retracted state to refill the soap reservoir 44. When the dispensing control 22 is released, it blocks water from traveling backward through the diverter valve 40, preventing the plunger 58 from returning prematurely.

Figure 5:
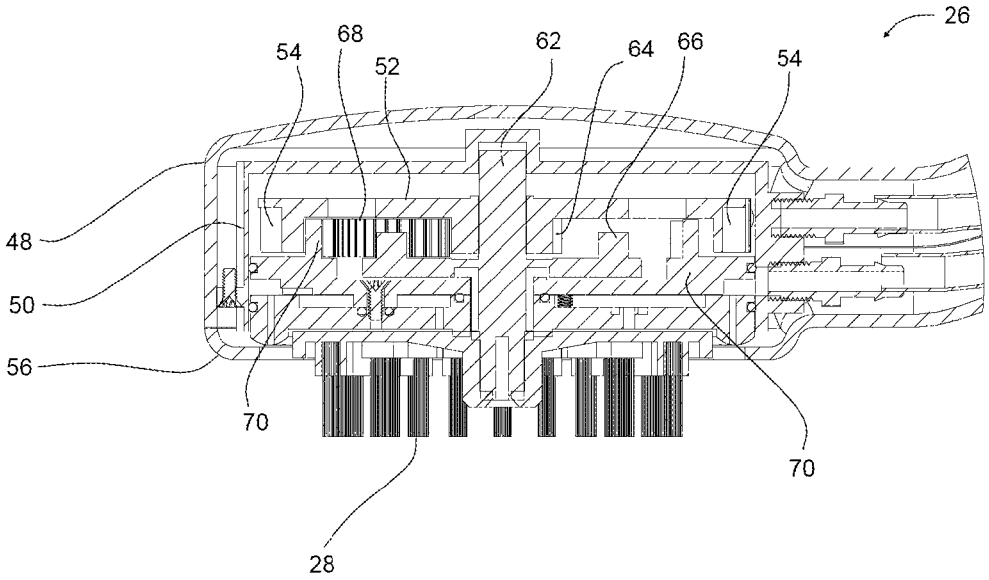
FIG. 5 illustrates an enlarged section view of the spray head of the shower sprayer.

Referring to FIG. 5 the enlarged spray head 26 is shown in section view. The spray head 26 includes the cylindrical case 48, which houses the capsule assembly 50. Inside the capsule assembly 50, the turbine 52 is rotatably mounted on a post 62, allowing it to spin as water presses against the vanes 54. Adjacent the post 62, the turbine 52 also includes a reducing gear 64. The post 62 includes support arms 66, one of which holds a planetary gear 68 that engages the reducing gear 64. A master ring gear 70 is statically mounted below the turbine 52, and also engages the planetary gear 68. The post 62 and support arms 66 are fixed to, and rotate in tandem with the brushes 28. The smaller circumference of the reducing gear 64 relative to the vanes 54 of the turbine 52 cause the planetary gear 68 to turn more slowly, so that less torque on the turbine 52 is required to turn the brushes 28.

Figure 6:
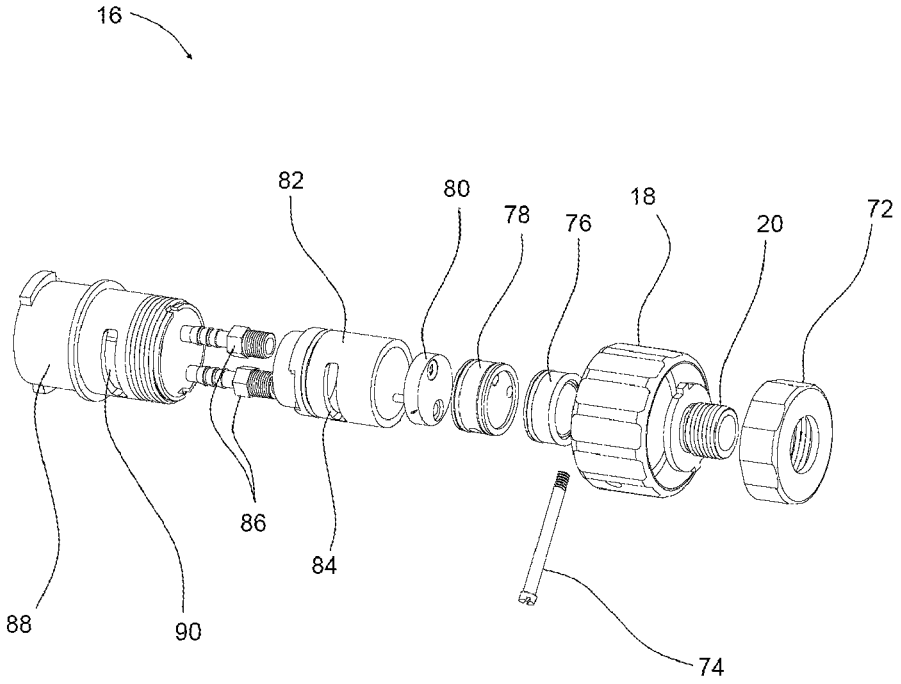
FIG. 6 illustrates an exploded view of the inlet valve assembly of the shower sprayer.

Referring to FIG. 6 the valve assembly 16 is shown in exploded view. The valve assembly 16 includes a coupling nut 72 that engages the connector 20 for coupling a water supply (not shown) to the shower sprayer 10. The connector 20 is surrounded by the selector 18, which accommodates a pin 74. The connector 20 is coupled to an inlet disc 76, which is coupled to a mixing disk 78. The pin 74 extending through the selector 18, extends through the mixing disk 78, so that when the selector 18 is turned, it turns the mixing disk 78 relative to a transfer disk 80. The transfer disk 80 governs whether the water supply travels through the first water line 36 directly to the spray head 26 or the second water line 38 to allow soap dispensing.

A sleeve cartridge 82 encases the transfer disk 80, mixing disk 78 and inlet disk 76, and extends through the selector 18. A first slot 84 in the sleeve cartridge 82 accommodates the pin 74, and limits rotational movement in the selector 18 to align the mixing disk 78 with the first water line 36 or second water line 38. A pair of water line connectors 86 engage the transfer disk 80 in the sleeve cartridge 82 and are attached to the first water line 36 and the second water line 38. A threaded shower body insert 88 engages the coupling nut 72 to hold the valve assembly 16 together, and to lock the valve assembly 16 into the shower sprayer 10. The shower body insert 88 includes a second slot 90 that aligns with the first slot 84 for governing movement of the pin 74.

Figure 7:
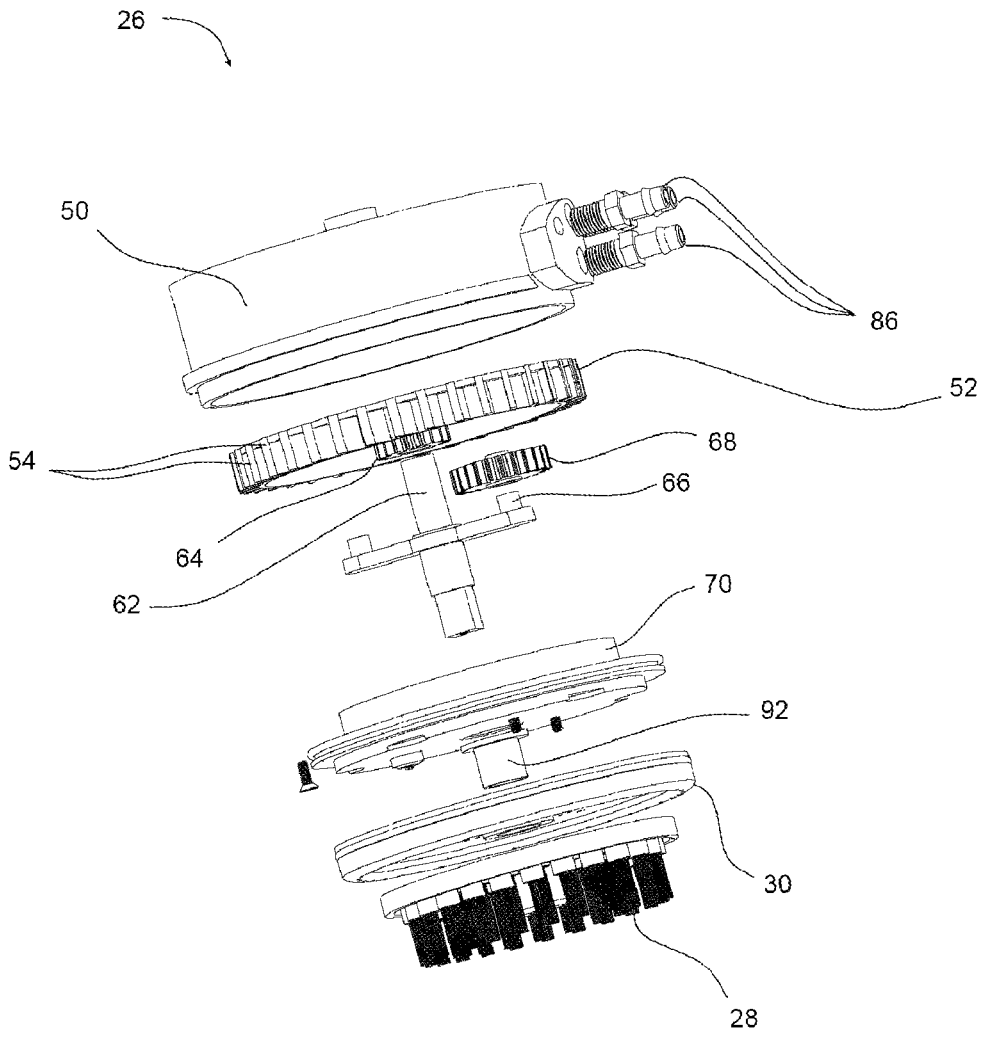
FIG. 7 illustrates an exploded view of the spinning brush assembly of the shower sprayer.

Referring to FIG. 7, an exploded view of the spray head 26 is shown. Water (not shown) enters the capsule assembly 50 through water line connectors 86. After entering the capsule assembly 50 under pressure, water acts on the vanes 54 of the turbine 52, causing it to turn rapidly, depending on water pressure. As the turbine 52 turns, its reducing gear 64 also turns, causing the planetary gear 68 to revolve around the master ring gear 70, although at a reduced rate of speed. Rotation of the planetary gear 68 causes the support arms 66 of the post 62 to rotate, which causes the brushes 28 to rotate in tandem with the planetary gear 68. Preferably, water travels around the turbine 52 and through the master ring gear 70 to reach the sprayer array 30, where it is ejected under pressure as the brush turns. A bushing 92 extending through the sprayer array 30 and the master ring gear 70 allows the post 62 to rotate freely relative to the master ring gear 70.

The structure of the shower sprayer 10 having been shown and described, its method of use will now be discussed.

To set up and use the shower sprayer 10, a user first affixes a water supply (not shown) to the connector 20, including installation of any hoses (not shown) or additional hardware such as a hand-held shower holder (not shown). The user then opens the refilling port 24 on the upper body housing 12 and introduces a preferred liquid soap (not shown) into the soap reservoir 44, preferably to capacity. Upon closing the refilling port 24 the shower sprayer 10 is ready for use.

To use the shower sprayer 10, the user activates the water supply, causing water to enter the shower sprayer 10 under pressure. Water passes into the valve assembly 16 through the connector 20, traveling through the inlet disk 76 and into the mixing disk 78. Initially, the mixing disk 78 may be set for soap-less operation. On this setting, the mixing disk 78 directs water through the transfer disk 80 and the water line connector 86 associated with the first water line 36. The first water line 36 leads directly to the spray head 26, where another water line connector 86 channels the water into the capsule assembly 50.

The capsule assembly 50 quickly fills with the pressurized water and as water continues entering the capsule assembly 50 under high pressure, it acts on the vanes 54 of the turbine 52, urging the turbine 52 into rotational movement around the post 62. As the turbine 52 spins, its reducing gear 64 spins in tandem, urging the planetary gear 68 into circular motion around the reducing gear 64, between the reducing gear 64 and the static master ring gear 70. The planetary gear 68, affixed to one of the support arms 66 of the post 62, rotates the post 62, thereby rotating the brushes 28. The epicyclic gearing arrangement allows the post 62 to rotate more slowly than the turbine 52, reducing the torque needed to rotate the brushes 28 as water presses against the vanes 54.

As water continues entering the capsule assembly 50 under pressure, it eventually passes through the sprayer array 30 in the manner of a conventional showerhead (not shown). The user may stand under the shower sprayer 10, or operate it in a hand-held manner according to preference. The brushes 28 continue to rotate as long as water is supplied to the shower sprayer 10.

When soap is desired, the user turns the selector 18 of the valve assembly 16. Turning the selector 18 causes the pin 74, extending through the second slot 90 of the shower body insert 88, and the first slot 84 of the sleeve cartridge 82, to rotate the mixing disk 78, which re-aligns the mixing disk 78 relative to the transfer disk 80, causing water to enter the water line connector 86 associated with the second water line 38. Water entering the second water line 38 travels to the spray head 26 in much the same way as water traveling through the first water line 36. In contrast, water passing through the second water line 38 encounters a diverter valve 40, biased to a closed position.

To dispense soap, the user simply depresses the dispensing control 22. The dispensing control 22 acts on the diverter valve 40, allowing a portion of the water traveling through the second water line 38 to enter the first soap line 42 under pressure. The pressurized water in the first soap line 42 enters the soap reservoir 44, urging the plunger 58 forward, thereby reducing the volume of the soap reservoir 44 and driving soap through the second soap line 46 and into the capsule assembly 50. The second soap line 44 enters the capsule assembly 50 below the master ring gear 70 to avoid viscous soap from interfering with the rapidly spinning turbine 52 and planetary gear 68, and to avoid frothing inside the spray head 26.

Soap-laden water exits the spray head 26 through the sprayer array 30, causing some lathering in the process. As the shower sprayer 10 moves over a surface, the rotating brushes 28 encounter the soap-laden water, thereby adding a scrubbing action and more lathering. After dispensing the desired amount of soap, the user simply releases the dispensing control 22, which causes the diverter valve 40 to its biased, closed position, and water rinses the spray head 26 clean of any remaining soap. Since the diverter valve 40 is closed, the plunger 58 in the soap reservoir 44 remains in a forward position, ready to continue dispensing soap the next time the diverter valve 40 is opened. Once the plunger 58 travels fully through the soap reservoir 44, the soap must be refilled.

To refill the shower sprayer 10 with soap, a user opens the refilling port 24 and depresses the dispensing control 22. The spring 60 in the soap reservoir 44 urges the plunger 58 back through the soap reservoir 44, and because the diverter valve 40 has been opened by depressing the dispensing control 22, water used to push the plunger 58 forward is permitted to drain out, moving backward through the second water line 38. With the plunger 58 reset to its starting position, the soap is poured through the refilling port 24 until it fills the soap reservoir 44. A user then closes the refilling port 24 and the shower sprayer 10 may be placed on its holder to be used again as desired.

The foregoing description of the preferred embodiment of the invention is sufficient in detail to enable one skilled in the art to make and use the invention. It is understood, however, that the detail of the preferred embodiment presented is not intended to limit the scope of the invention, in as much as equivalents thereof and other modifications which come within the scope of the invention as defined by the claims will become apparent to those skilled in the art upon reading this specification.

What is claimed is:

1. A handheld soap dispensing scrubbing shower sprayer for receiving a water supply and dispensing a soap comprising:

a spray head having a sprayer array and a turbine coupled to a brush for moving the brush;

a first water line and a second water line supplying the water supply to the spray head;

the first water line routing the water supply to the sprayer array;

the second water line routing the water supply through the turbine to the sprayer array such that the water supply moves the brush;

a diverter valve in fluid communication with the second water line and a soap reservoir containing the soap; and a selector for opening the diverter valve to divert some of the water supply in the second water line against a plunger, urging the plunger forward, and reducing the volume of the soap reservoir, thereby driving the soap from the soap reservoir into the sprayer array.

2. The shower sprayer of claim 1 further comprising a reducing gear between the turbine and the brush.

3. The shower sprayer of claim 2 further comprising a planetary gear engaging the reducing gear between the turbine and the brush.

4. The shower sprayer of claim 1 wherein the sprayer array encircles the brush.

5. The shower sprayer of claim 1 wherein the soap reservoir comprises a refilling port for adding soap to the soap reservoir.

6. The shower sprayer of claim 1 further comprising a dispensing control coupled to the diverter valve for manually activating the diverter valve.

7. The shower sprayer of claim 1 wherein the selector rotates, causing the water supply to engage either the first water line or the second water line.

8. A handheld soap dispensing scrubbing shower sprayer for connecting to a water supply and dispensing a soap comprising:

a spray head having a sprayer array and a turbine, the turbine coupled to a brush;

the spray head in fluid communication with a first water line and a second water line;

the first water line routed into the spray head such that the water supply is directed around the turbine and out the sprayer array;

the second water line routed into the spray head such that the water supply drives the turbine before exiting the sprayer array;

the second water line having a diverter valve for diverting some of the water supply in the second water line against a plunger housed in the soap reservoir, urging the plunger forward and reducing the volume in the soap reservoir, thereby driving the soap into the spray head while the brush moves.

9. The shower sprayer of claim 8 further comprising a reducing gear in the spray head between the turbine and the brush.

10. The shower sprayer of claim 7 further comprising a planetary gear in the spray head engaging a reducing gear between the turbine and the brush.

11. The shower sprayer of claim 8 wherein the sprayer array encircles the brush.

12. The shower sprayer of claim 8 wherein the soap reservoir comprises a refilling port for adding soap to the soap reservoir.

13. The shower sprayer of claim 8 further comprising a dispensing control coupled to the diverter valve for manually activating the diverter valve.

14. The shower sprayer of claim 8 wherein a selector rotates to alternate between the first water line and the second water line.

15. A handheld soap dispensing scrubbing shower sprayer for connecting to a water supply, dispensing a soap and scrubbing a user, the shower sprayer comprising:

a valve assembly connectable to the water supply, the valve assembly comprising a selector for selectively diverting the water supply through a first water line and a second water line to a spray head;

the spray head comprising a sprayer array, a brush and means for moving the brush;

the second water line routed into the spray head such that the water supply drives the means for moving the brush before exiting the sprayer array;

a diverter valve in fluid communication with the second water line and a soap reservoir; and wherein the diverter valve opens to divert some of the water supply in the second water line against the soap reservoir, and pressure against the soap reservoir urges the soap out of the soap reservoir and into the spray head for soaping the user as the brush moves.

16. The shower sprayer of claim 15 wherein the means for moving comprises a reducing gear for added torque when moving the brush.

17. The shower sprayer of claim 15 further comprising a dispensing control coupled to the diverter valve for manually activating the diverter valve.

18. The shower sprayer of claim 15 further comprising a refilling port for adding the soap to the soap reservoir.

* * * * *